US007900562B2

(12) United States Patent
Esposti et al.

(10) Patent No.: US 7,900,562 B2
(45) Date of Patent: Mar. 8, 2011

(54) SPLIT RAIL TROLLEY SYSTEM

(75) Inventors: Albert Esposti, Brookfield, CT (US); Stanislaw Kostrzewski, Newtown, CT (US); Thomas Hannon, Milford, CT (US); Thomas E. Young, Southbury, CT (US)

(73) Assignee: Macton Corporation, Oxford, CT (US)

( * ) Notice: Subject to any disclaimer, the term of this patent is extended or adjusted under 35 U.S.C. 154(b) by 0 days.

(21) Appl. No.: 12/247,336

(22) Filed: Oct. 8, 2008

(65) Prior Publication Data

US 2009/0145326 A1 Jun. 11, 2009

Related U.S. Application Data

(60) Provisional application No. 60/979,595, filed on Oct. 12, 2007.

(51) Int. Cl.
*B61K 5/00* (2006.01)

(52) U.S. Cl. ..... 104/32.1; 104/33; 187/216

(58) Field of Classification Search ..... 104/32.1, 104/33, 262–274, 307; 187/205, 214, 216; 105/178

See application file for complete search history.

(56) References Cited

U.S. PATENT DOCUMENTS 1,706,211 A * 3/1929 Coffey ..... 254/7 R
1,751,076 A * 3/1930 Davis, Jr. ..... 104/32.1
1,866,798 A * 7/1932 Hugh ..... 104/32.1
2,260,623 A * 10/1941 Holmes ..... 104/32.1
2,494,099 A 11/1948 Mandelko et al.
2,718,851 A * 9/1955 Holdeman ..... 104/32.1
3,251,311 A * 5/1966 Saxonmeyer ..... 104/32.1
3,367,283 A * 2/1968 Ladoues et al. ..... 104/32.1
4,506,424 A * 3/1985 Ulbing ..... 29/252
5,370,058 A 12/1994 David
2004/0188662 A1 9/2004 Shah et al.

* cited by examiner

*Primary Examiner* — S. Joseph Morano
*Assistant Examiner* — Zachary Kuhfuss
(74) *Attorney, Agent, or Firm* — Otterstedt, Ellenbogen & Kammer, LLP; Paul J. Otterstedt

(57) ABSTRACT

An apparatus for removing a wheelset from a railroad vehicle includes a frame configured for motion with respect to the railroad vehicle. The apparatus also includes a lifting yoke cooperatively associated with the frame. The yoke is configured to engage flanges of the wheelset. The apparatus further includes at least one lifting screw interposed between the frame and the lifting yoke, such that upon rotation of the at least one lifting screw, the yoke may be raised and lowered to selectively engage the flanges of the wheelset. A "universal" lifting yoke can include a first portion which engages the at least one lifting screw, a set of extendable transverse members having outward ends, and flange-engaging blocks secured to the outward ends of the extendable transverse members and configured to engage the flanges of the wheelset. The extendable transverse members and the flange-engaging blocks can be cooperatively configured and dimensioned to engage substantially all anticipated wheelsets expected to be encountered in a given application. The "universal yoke" can be employed with screw-actuation, or with other types of actuating members.

7 Claims, 4 Drawing Sheets

SPLIT RAIL TROLLEY SYSTEM

CROSS-REFERENCE TO RELATED APPLICATIONS

This patent application claims the benefit of U.S. Provisional Patent Application Ser. No. 60/979,595 filed on Oct. 12, 2007, and entitled "Split Rail Trolley System." The complete disclosure of the aforementioned Provisional Patent Application Ser. No. 60/979,595 is expressly incorporated herein by reference in its entirety for all purposes.

FIELD OF THE INVENTION

The present invention generally relates to the mechanical and transportation arts, and, more particularly, to railroad maintenance equipment.

BACKGROUND OF THE INVENTION

Split rail trolley systems have been used in the past for vehicle wheelset removal. Trolley systems have all been hydraulically powered and have been designed to require a deep pit to ride in and to accommodate only one wheelset configuration per adapter set.

The hydraulic systems of prior art systems can fail, causing the supported wheelset (or entire end of the rail car) to drop down. Further, only one specific type of wheelset can be serviced with a single adapter, requiring multiple adapters to service different wheelsets. Yet further, the hydraulic systems require a high degree of maintenance and represent a potential environmental hazard, and the hydraulic cylinders require a deep foundation.

SUMMARY OF THE INVENTION

Principles of the present invention provide techniques for split rail trolley systems. In an exemplary embodiment, according to one aspect of the invention, an apparatus for removing a wheelset from a railroad vehicle includes a frame configured for motion with respect to the railroad vehicle. The apparatus also includes a lifting yoke cooperatively associated with the frame. The yoke is configured to engage flanges of the wheelset. The apparatus further includes at least one lifting screw interposed between the frame and the lifting yoke, such that upon rotation of the at least one lifting screw, the yoke may be raised and lowered to selectively engage the flanges of the wheelset.

In one or more instances, a "universal" yoke may be employed. Such a "universal" lifting yoke can include a first portion which engages the at least one lifting screw, a set of extendable transverse members having outward ends, and flange-engaging blocks secured to the outward ends of the extendable transverse members and configured to engage the flanges of the wheelset. The extendable transverse members and the flange-engaging blocks can be cooperatively configured and dimensioned to engage substantially all anticipated wheelsets expected to be encountered in a given application. The "universal yoke" can be employed with screw-actuation, or with other types of actuating members.

One or more embodiments of the invention may provide one or more of the following advantages: universal use on any wheelset, self-locking in any position in the event of power system failure, and/or accommodation in a relatively shallow foundation configuration.

These and other objects, features and advantages of the present invention will become apparent from the following detailed description of illustrative embodiments thereof, which is to be read in connection with the accompanying drawings.

DETAILED DESCRIPTION OF PREFERRED EMBODIMENTS

One or more embodiments of the invention enable removal of wheels and/or wheelsets from railroad locomotives and/or or rolling stock, such as passenger and/or freight train cars, and one or more embodiments have the ability to independently traverse and be used for such vehicle wheelset removal. Further, one or more embodiments provides an apparatus for the removal of wheelsets from a vehicle such as a passenger and/or freight train, preferably allowing substantially any wheelset to be removed with only a single adapter (see discussion of element 126 below).

Even further, one or more inventive embodiments provide such an apparatus which is capable of removing wheelsets in a safe manner by mechanically controlling the removal of the wheelset. Still further, one or more inventive embodiments may be mounted in a relatively shallow pit. Yet further, one or more exemplary embodiments of an apparatus according to the invention can include a battery powered trolley to traverse the shallow pit and position a lifting mechanism under the wheelset to be removed. Such trolley may include a frame (preferably steel) to which some or all of the electrical and mechanical components can be mounted. The exemplary lift mechanism includes machine screws, for example, four machine screw jacks that are driven by a common electrically powered motor through a combination of gearboxes, driveshafts and motors. The exemplary trolley further includes a lifting frame (preferably steel) attached to the four jacks and housing four lockable steel extension arms that can be moved out to contact the two flanges of the wheels, allowing a wheelset with substantially any configuration to be picked up and supported while the removable rail sections are unlocked and opened. Once the wheelset is disconnected from the vehicle it can be lowered to a point where the wheelset can be extracted from under the transit vehicle.

Figure 1:
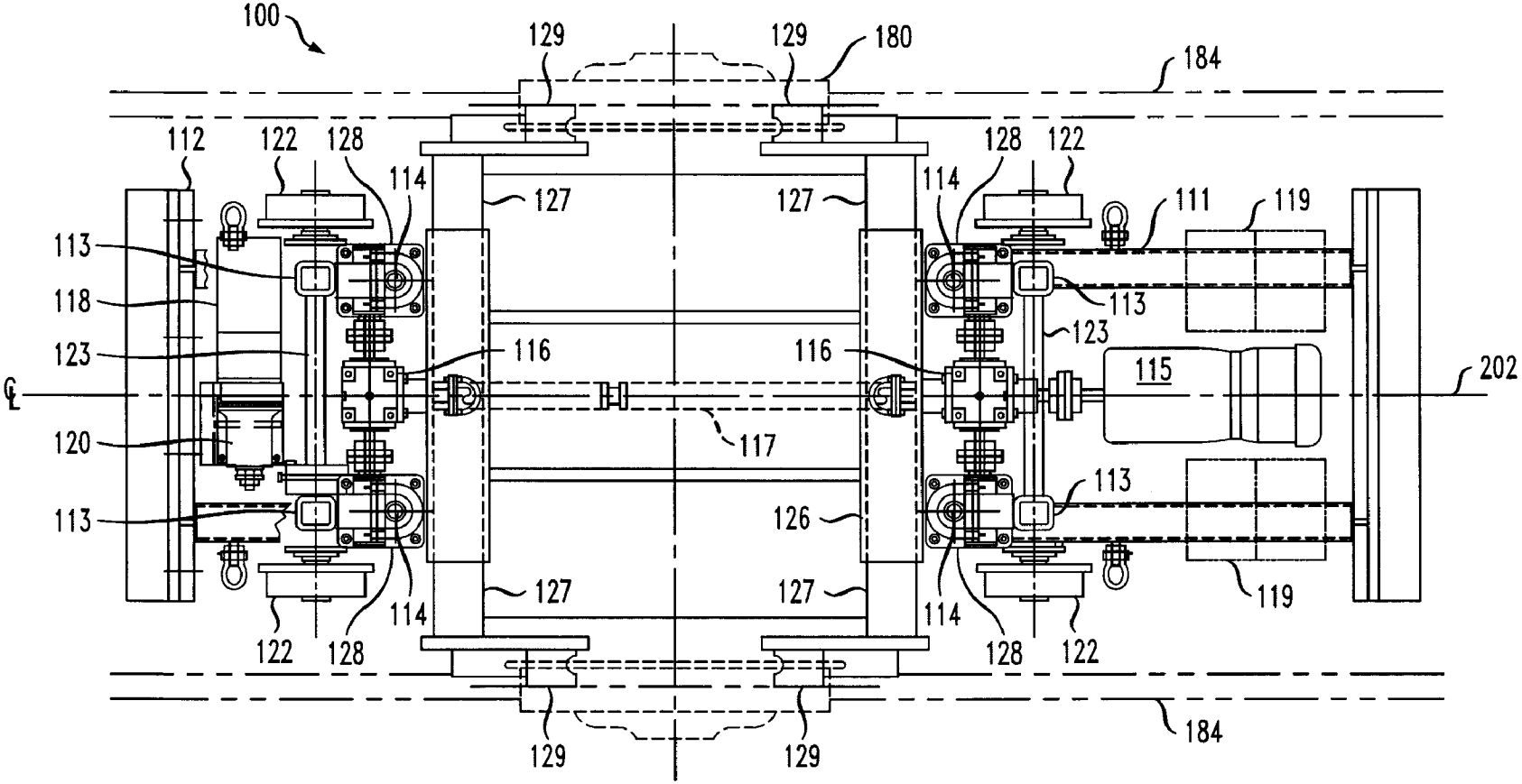
FIG. 1 is a top view of an exemplary apparatus according to the present invention, with all covers omitted for clarity.
Figure 2:
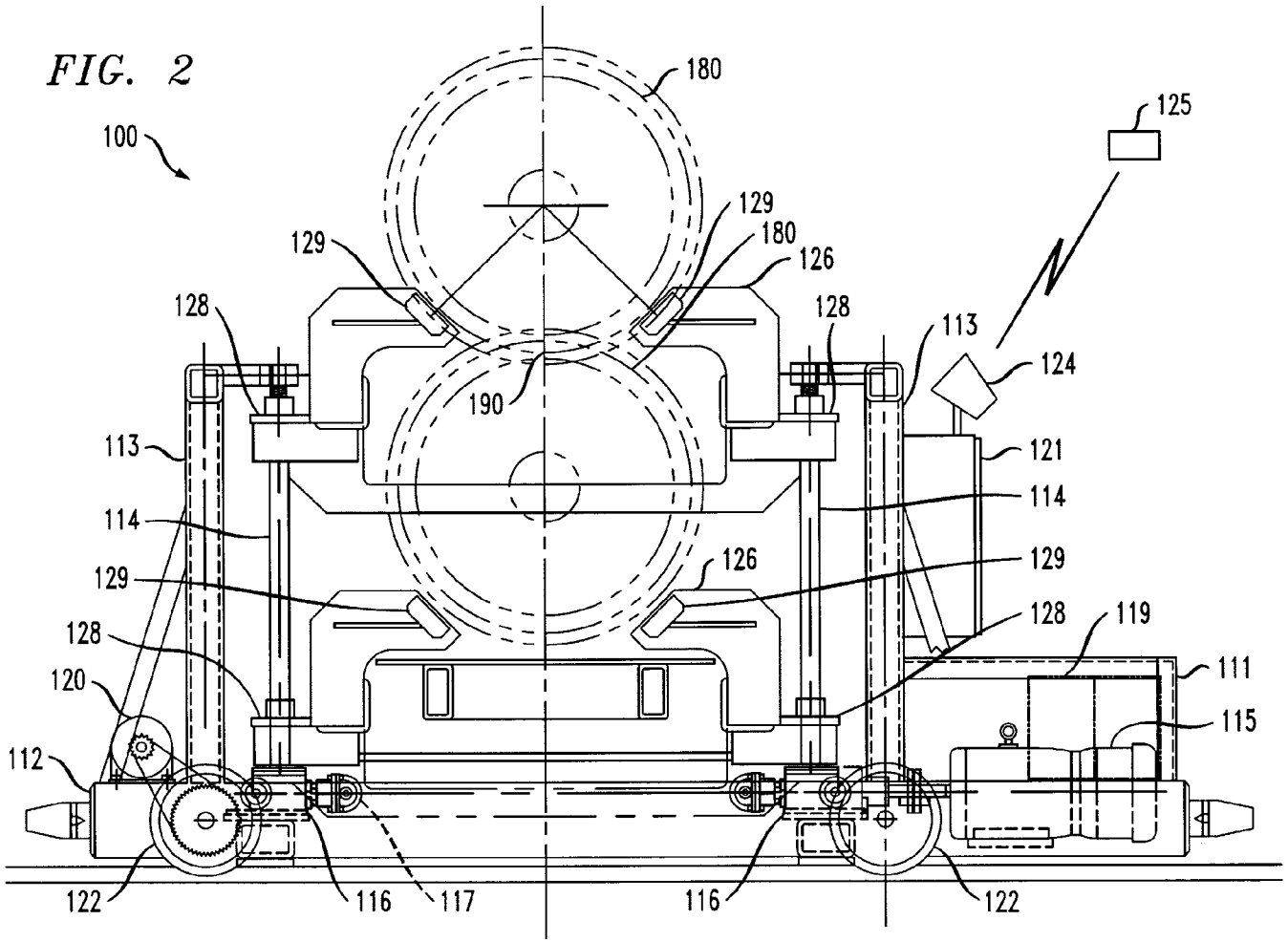
FIG. 2 is a side elevation view of the exemplary apparatus of FIG. 1.
Figure 3:
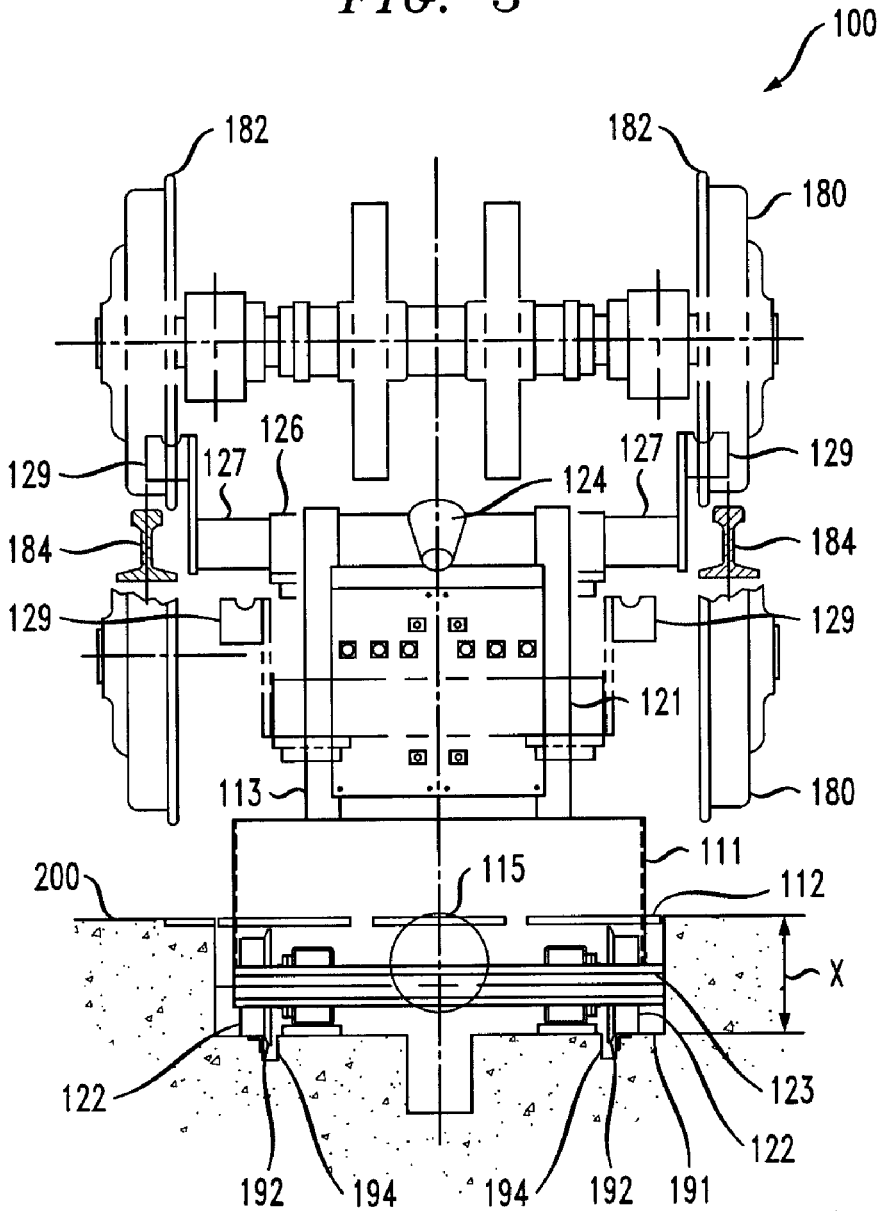
FIG. 3 is a front elevation view of the exemplary apparatus of FIG. 1.

For a detailed exemplary description of one particular preferred embodiment, reference should now be had to FIGS. 1-3, which depict an exemplary inventive apparatus 100. Apparatus 100 includes a main structural frame 111 (preferably steel), including a base 112 and upright guide columns 113 (preferably four). Vertical lifting screws 114 (preferably four) are attached to the base 112 and upright guide columns 113 and driven by an electric motor 115 through gearboxes 116 connected by a driveshaft 117 (which can be provided with suitable universal joints, not separately numbered). Motor 115 can receive electric power (for example, 480 VAC), via a line cord or cable. Apparatus 100 may travel, for example, approximately two hundred feet under a train and may interface with four or five removal stations in a manner known per se to the skilled artisan; each removal station may be provided with an electric outlet to power motor 115. Also attached to the frame 111 is a battery powered motor 118 used for linear travel, battery(ies) 119, linear drive speed reducer 120 and control panel 121 for both the linear and lifting motions (under action of motors 118, 115, respectively). Also attached to the frame are linear travel wheels 122 and axles 123. Motor 118 may provide power to wheels 122 on at least one axle 123 through reducer 120, and, for example, a chain and sprocket arrangement best seen in FIG. 2 and not separately numbered. In an alternative embodiment, power for motor 118 could be provided by a conductor bar feed system; powering motor 118 by a cable would likely not be feasible for longer length runs (say, about 200 feet) but might be feasible for shorter runs, such as about 75-100 feet). A work light 124 is attached to the control panel 121. The light 124, and indeed any control on control panel 121, can preferably be activated by a radio remote control 125. The skilled artisan, given the teachings herein and knowledge of the loads anticipated, based on the vehicles to be accommodated, can select electric motors 115, 118, having suitable torque and power characteristics; batteries 119 having appropriate voltages and sufficient ampere-hours; appropriate ratios for gearboxes 116 and reducer 120, appropriate pitch for machine screws 114, and so on.

Figure 4:
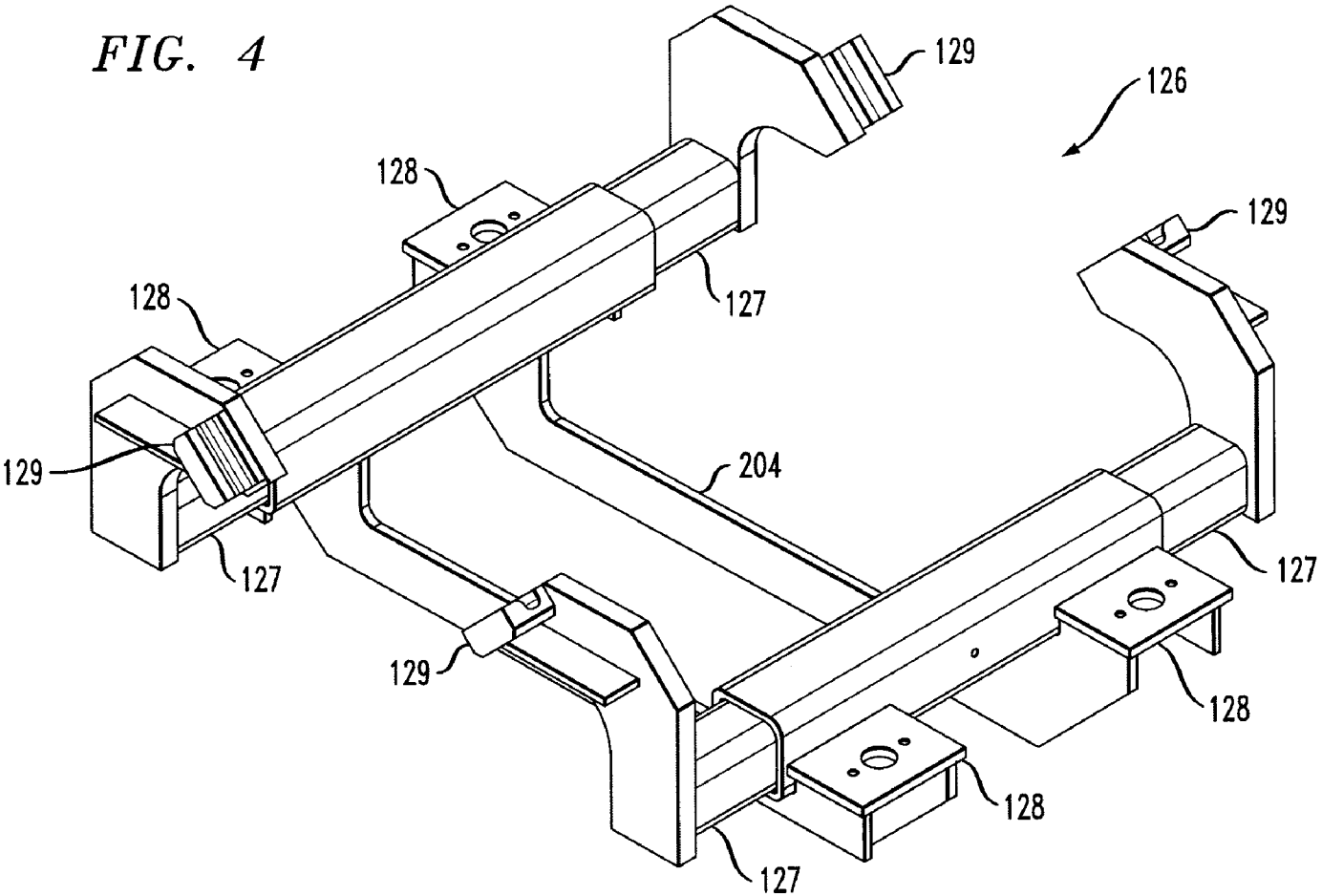
FIG. 4 is a perspective view of an exemplary embodiment of a universal lifting yoke or frame, according to an aspect of the invention.

Mounted to the upright screws 114 is a universal telescoping lifting frame or yoke 126 that is used to lift and lower the wheelset 180. Note that FIGS. 2 and 3 depict apparatus 100 in both a raised and lowered configuration. As best seen in FIG. 4, the lifting frame 126 includes telescoping arms 127, lifting screw interface plates 128, and the wheel flange capture blocks 129. Each end of each screw 114 is preferably captured in a bearing on the frame 111 and each screw 114 engages female threads in bronze (or similar) nuts secured to plates 128 (for example, via two bolts), causing frame 126 to raise or lower upon rotation of the screws 114. The nuts are omitted from FIG. 4 for clarity and are best seen in FIG. 2 (not separately numbered). Arms 127 of frame or yoke 126 permit wheelsets of substantially any gauge of interest to be handled, while blocks 129 are cooperatively configured and dimensioned together with framework 204 to accommodate wheels of substantially any diameter of interest.

In operation, a transit vehicle is located over a standard removable rail opening, and the operator of the apparatus 100 uses the remote control 125 (for example, an infra-red (IR) remote) to activate the linear drive motor 118 to move the apparatus 100 into position under the vehicle axle to be removed (for example, that of wheelset 180). For clarity, only wheelset 180, and not the remainder of the rail vehicle, is depicted in the figures. Note track centerline 202. Once in position, the operator uses the remote control 125 to activate the electric motor 115 and cause the four vertical lifting screws 114 to rotate and lift the universal telescoping lifting frame 126. Given the teachings herein, the skilled artisan can employ known electronic components to implement the functionality of control 125 and panel 121. Once the universal telescoping lifting frame 126 has reached the appropriate height, the operator manually extends the telescoping arms 127 until blocks 129 are lined up with the wheel flanges 182 of wheelset 180, as best seen in FIG. 3. FIG. 3 shows the arms 127 in both retracted and extended configurations. Blocks 129 engage flanges 182 of wheels 180 away from the point of contact of wheels 180 with rails 184 (the six o'clock position 190 is the point of contact, as seen in FIG. 2). The universal telescoping lifting frame 126 is then raised up until the transit vehicle is lifted slightly off the rails 184. The axle of wheelset 180 is then disconnected from the vehicle for removal and the vehicle blocked up. The removable rail sections 184 are then unlocked and taken out of the way allowing the universal telescoping lifting frame 126 to be lowered with the wheelset 180. The wheelset can then be removed by known techniques.

The process is reversed to replace the wheelset 180.

As best seen in FIG. 3, apparatus 100 rides on wheels 122 in a pit 191. Flanges 192 on wheels 122 can ride in depressions 194 on the floor of pit 191. Pit 191 can have a depth, X, of about 1 to 2 feet. Depths at the lower end of this range are feasible for rolling stock such as passenger cars. Depths at the upper end of this range may be appropriate for systems employed with locomotives, since larger capacity lifting screws may be required for such applications.

It will thus be appreciated that an apparatus 100 for removing a wheelset 180 from a railroad vehicle can include a frame 111 configured for motion with respect to the railroad vehicle and a lifting yoke 126 cooperatively associated with the frame 111. The yoke 126 is configured to engage flanges 182 of the wheelset 180. At least one lifting screw 114 (preferably four) is/are interposed between the frame 111 and the lifting yoke 126, such that upon rotation of the at least one lifting screw 114, the yoke 126 may be raised and lowered to selectively engage the flanges 182 of the wheelset 180. In a preferred form, the lifting yoke 126 in turn includes a first portion (framework 204 with plates 128) which engages the at least one lifting screw 114, and a set of extendable transverse members 127 having outward ends to which flange-engaging blocks 129 are secured. Blocks 129 are configured to engage the flanges 182 of the wheelset 180. The extendable transverse members 127 and the flange-engaging blocks 129 are cooperatively configured and dimensioned to engage substantially all anticipated wheelsets 180 expected to be encountered in a given application.

In at least some instances, the apparatus 100 is configured and dimensioned to be installed in a pit 191 sunken below a maintenance facility main surface 200, and the pit 191 has a depth of about 1 foot to about 2 feet, depending on the application, as set forth above.

In another aspect, an apparatus may be similar to the kind of apparatus 100 just described, and may employ an embodiment of the inventive lifting yoke such as 126, but may use at least one lifting member other than a screw for raising and lowering. That is, yoke 126 may be employed with other types of maintenance apparatus besides those using lifting screws.

It will be appreciated and should be understood that the exemplary embodiments of the invention described above can be implemented in a number of different fashions. Given the teachings of the invention provided herein, one of ordinary skill in the related art will be able to contemplate other implementations of the invention.

Although illustrative embodiments of the present invention have been described herein with reference to the accompanying drawings, it is to be understood that the invention is not limited to those precise embodiments, and that various other changes and modifications may be made by one skilled in the art without departing from the scope of spirit of the invention.

What is claimed is:

1. An apparatus for removing a wheelset from a railroad vehicle, said apparatus comprising:

a frame configured for motion with respect to the railroad vehicle;

a lifting yoke cooperatively associated with said frame, said yoke being configured to engage flanges of the wheelset; and at least one lifting screw interposed between said frame and said lifting yoke, such that upon rotation of said at least one lifting screw, said yoke may be raised and lowered to selectively engage the flanges of the wheelset;

wherein:

said lifting yoke in turn comprises:

a first portion which engages said at least one lifting screw;

a set of extendable transverse members, associated with said first portion, and having outward ends; and flange-engaging blocks secured to said outward ends of said extendable transverse members and configured to engage the flanges of the wheelset; and said extendable transverse members and said flange-engaging blocks are cooperatively configured and dimensioned to engage substantially all anticipated wheelsets expected to be encountered in a given application.

2. The apparatus of claim 1, wherein said apparatus is configured and dimensioned to be installed in a pit sunken below a maintenance facility main surface, and wherein said pit has a depth of about one foot.

3. The apparatus of claim 1, wherein said apparatus is configured and dimensioned to be installed in a pit sunken below a maintenance facility main surface, and wherein said pit has a depth of about two feet.

4. An apparatus for removing a wheelset from a railroad vehicle, said apparatus comprising:

a frame configured for motion with respect to the railroad vehicle;

a lifting yoke cooperatively associated with said frame, said yoke being configured to engage flanges of the wheelset; and at least one lifting member interposed between said frame and said lifting yoke, such that upon actuation of said at least one lifting member, said yoke may be raised and lowered to selectively engage the flanges of the wheelset;

wherein:

said lifting yoke in turn comprises:

a first portion which engages said at least one lifting member;

a set of extendable transverse members, associated with said first portion, and having outward ends; and flange-engaging blocks secured to said outward ends of said extendable transverse members and configured to engage the flanges of the wheelset; and said extendable transverse members and said flange-engaging blocks are cooperatively configured and dimensioned to engage substantially all anticipated wheelsets expected to be encountered in a given application.

5. An apparatus for removing a wheelset from a railroad vehicle, said apparatus comprising:

a frame configured for motion with respect to the railroad vehicle;

a lifting yoke cooperatively associated with said frame, said yoke being configured to engage flanges of the wheelset; and at least one lifting screw interposed between said frame and said lifting yoke, such that upon rotation of said at least one lifting screw, said yoke may be raised and lowered to selectively engage the flanges of the wheelset;

wherein said lifting yoke comprises a set of extendable transverse members with outward ends configured and dimensioned to engage the flanges of the wheelset.

6. An apparatus for removing a wheelset from a railroad vehicle, said apparatus comprising:

a frame configured for motion with respect to the railroad vehicle;

a lifting yoke cooperatively associated with said frame, said yoke being configured to engage flanges of the wheelset; and at least one lifting member interposed between said frame and said lifting yoke, such that upon actuation of said at least one lifting member, said yoke may be raised and lowered to selectively engage the flanges of the wheelset;

wherein said lifting yoke comprises a set of extendable transverse members with outward ends configured and dimensioned to engage the flanges of the wheelset.

7. An apparatus for removing a wheelset from a railroad vehicle, said apparatus comprising:

a frame configured for motion with respect to the railroad vehicle;

a lifting yoke cooperatively associated with said frame, said lifting yoke having first and second sides, each with two opposed wheel engaging members configured and dimensioned to engage a corresponding wheel of the wheelset away from a rail point of contact; and at least one lifting member interposed between said frame and said lifting yoke, such that upon actuation of said at least one lifting member, said yoke may be raised and lowered to selectively engage the wheels of the wheelset;

wherein said lifting yoke further comprises:

a first portion which engages said at least one lifting member; and a set of extendable transverse members, associated with said first portion, and having outward ends, said wheel engaging members being secured to said outward ends of said extendable transverse members.

* * * * *